US005117636A

United States Patent [19]

Bechtel, II et al.

[11] Patent Number: 5,117,636

[45] Date of Patent: Jun. 2, 1992

[54] LOW $NO_x$ EMISSION IN GAS TURBINE SYSTEM

[75] Inventors: William T. Bechtel, II, Schenectady; Masayoshi Kuwata, Ballston Lake; Roy M. Washam, Schenectady, all of N.Y.

[73] Assignee: General Electric Company, N.Y.

[21] Appl. No.: 474,394

[22] Filed: Feb. 5, 1990

[51] Int. Cl.[5] ..... F02C 3/14

[52] U.S. Cl. ..... 60/738; 60/757

[58] Field of Search ..... 60/732, 737, 738, 755, 60/757, 759, 39.06

[56] References Cited

U.S. PATENT DOCUMENTS

| | | | |
|---|---|---|---|
| 3,851,466 | 12/1974 | Verdouw | 60/737 |
| 3,946,553 | 3/1976 | Roberts et al. | 60/39 |
| 3,958,413 | 5/1976 | Cornelius et al. | 60/39 |
| 3,958,416 | 5/1976 | Hammond, Jr. et al. | 60/39 |
| 4,292,801 | 10/1981 | Wilkes et al. | 60/39 |
| 4,420,929 | 12/1983 | Jorgensen et al. | 60/39 |
| 4,455,839 | 6/1984 | Wuchter | 60/747 |
| 4,819,438 | 4/1989 | Schultz | 60/732 |
| 4,845,940 | 7/1989 | Beer | 60/732 |
| 4,912,931 | 4/1990 | Joshi | 60/732 |

FOREIGN PATENT DOCUMENTS

| | | | |
|---|---|---|---|
| 367662 | 4/1963 | Switzerland | 60/759 |
| 2116308 | 9/1983 | United Kingdom | 60/732 |

*Primary Examiner*—Louis J. Casaregola

[57] ABSTRACT

An improved gas turbine combustor is provided which reduces nitric oxide emissions through premixing of the fuel gas and air and feeding the mixture through a venturi, providing an air cooled passage around the venturi, and extending the passage downstream toward the combustion zone to optimize the stability of the combustion and reduce $NO_x$ and CO emissions.

15 Claims, 2 Drawing Sheets

LOW $NO_x$ EMISSION IN GAS TURBINE SYSTEM

BACKGROUND OF THE INVENTION

In recent years, gas turbine manufacturers have become increasingly concerned with pollutant emissions. Of particular concern has been the emissions of nitrogen oxides ($NO_x$) because such oxides are a precursor to air pollution.

It is known that $NO_x$ formation increases with increasing flame temperature and with increasing residence time. It is therefore theoretically possible to reduce $NO_x$ emissions by reducing flame temperature and/or the time at which the reacting gases remain at the peak temperatures. In practice, however, this is difficult to achieve because of the turbulent diffusion flame characteristics of present day gas turbine combustors. In such combustors, the combustion takes place in a thin layer surrounding either the evaporating liquid fuel droplets or the dispensing gaseous fuel jets at a fuel/air equivalence ratio near unity regardless of the overall reaction zone equivalence ratio. Since this is the condition which results in the highest flame temperature, relatively large amounts of $NO_x$ are produced.

It is also known that the injection of significant amounts of water or steam can reduce $NO_x$ production so that the conventional combustors can meet the low $NO_x$ emission requirements. However, such injection also has many disadvantages including an increase in system complexity, an increase in operating costs due to the necessity for water treatment, and the degrading of other performane parameters.

The problem of realizing low $NO_x$ emissions becomes even further complicated when it is necessary to meet other combustion design criteria. Among such criteria are those of good ignition qualities, good crossfiring capability, stability over the entire load range, low traverse number or flat exhaust temperature profile, long life and the ability to operate safely.

Some of the factors which result in the formation of nitrogen oxides from fuel nitrogen and air nitrogen are known and efforts have been made to adapt various combustor operations in light of these factors. See, for example, U.S. Pat. Nos. 3,958,413; 3,958,416; 3,946,553; and 4,420,929. The processes used heretofore, however, have either not been adaptable for use in a combustor for a stationary gas turbine or adequate for the reasons set fort below.

A venturi configuration can be used to stabilize the combustion flame. In such arrangements, lowered $NO_x$ emissions are achieved by lowering peak flame temperatures through the burning of a lean, uniform mixture of fuel and air. Uniformity is achieved by premixing fuel and air in the combustor upstream of the venturi and then firing the mixture downstream of the venturi sharp-edged throat. The venturi configuration, by virtue of accelerating the flow preceding the throat, is intended to keep the flame from flashing back into the premixing region. Further, the nature of the flow adjacent the downstream wall of the venturi is a zone of separated flow and is believed to serve as a flame holding region. This flame holding region is required for continuous, stable, premixed fuel burning. Because the venturi walls bound a combustion flame, they must be cooled. This is accomplished with back side impingement air which then dumps into the combustion zone at the downstream end of the venturi. However, such arrangements have not been entirely satisfactory.

U.S. Pat. No. 4,292,801 of Wilkes and Hilt, assigned to the same assignee as the present inventor, and which is hereby incorporated by reference, describes a gas turbine combustor which has an upstream combustion chamber and a downstream combustion chamber separated by a venturi throat or constriction region. Other patent applications directed at reducing the $NO_x$ emissions include application Ser. No. (51DV-2910) and application Ser. No. (51DV-2903), both of M. Kuwata, J. Waslo and R. Washam and assigned to the same assignee as the present invention, and which are hereby incorporated by reference. Application Ser. No. (51DV-2903) is directed at premixed fuel and air combustor arrangements including a venturi.

Premixed fuel combustion by its nature is very unstable. The unstable condition can lead to a situation in which the flame cannot be maintained, which is referred to as "blow-out". This is especially true as the fuel-air stoichiometry is decreased to just above the lean flammability limit, a condition that is required to achieve low levels of $NO_x$ emissions. The problem to be solved with the premixed dry low $NO_x$ combustor is to lean out the fuel-air mixture to reduce $NO_x$ while maintaining a stable flame at the desire operating temperature. Further, it is desirable to have stable premixed burning over a wide range in combustion temperature to allow for greater flexibility in operation of the gas turbine, and to increase the product life of turbine combustion systems.

OBJECTS AND SUMMARY OF INVENTION

Accordingly, it is an object of the present invention to reduce the nitric oxide ($NO_x$) emissions in a turbine combustion system while maintaining a stable flame at the desired operating temperature.

A second object of the present invention to provide a turbine combustion system exhibiting a stable premixed burning over a wide range in combustion temperatures.

A third object of the present invention to provide a dry low $NO_x$ turbine combustion system utilizing an improved venturi fuel and air feed which provides improved turbine combustion.

A fourth object of the present invention to provide an improved turbine combustion system with reduced system pressure dynamics.

Still another object of the present invention to improve the life of a low $NO_x$ turbine combustion system.

With the aforementioned objects in view, the present invention resides in a gas turbine with low nitric oxides emissions in which fuel gas and air are premixed and then fed through a venturi to the combustion chamber. The venturi is air cooled and includes a substantially cylindrical passage attached to the downstream throat of the venturi and extending into the combustion chamber, controlling reverse flow of the venturi cooling air into the separated region adjacent the venturi downstream wall and improving the stability of the premixed fuel burning operation.

Figure 1:
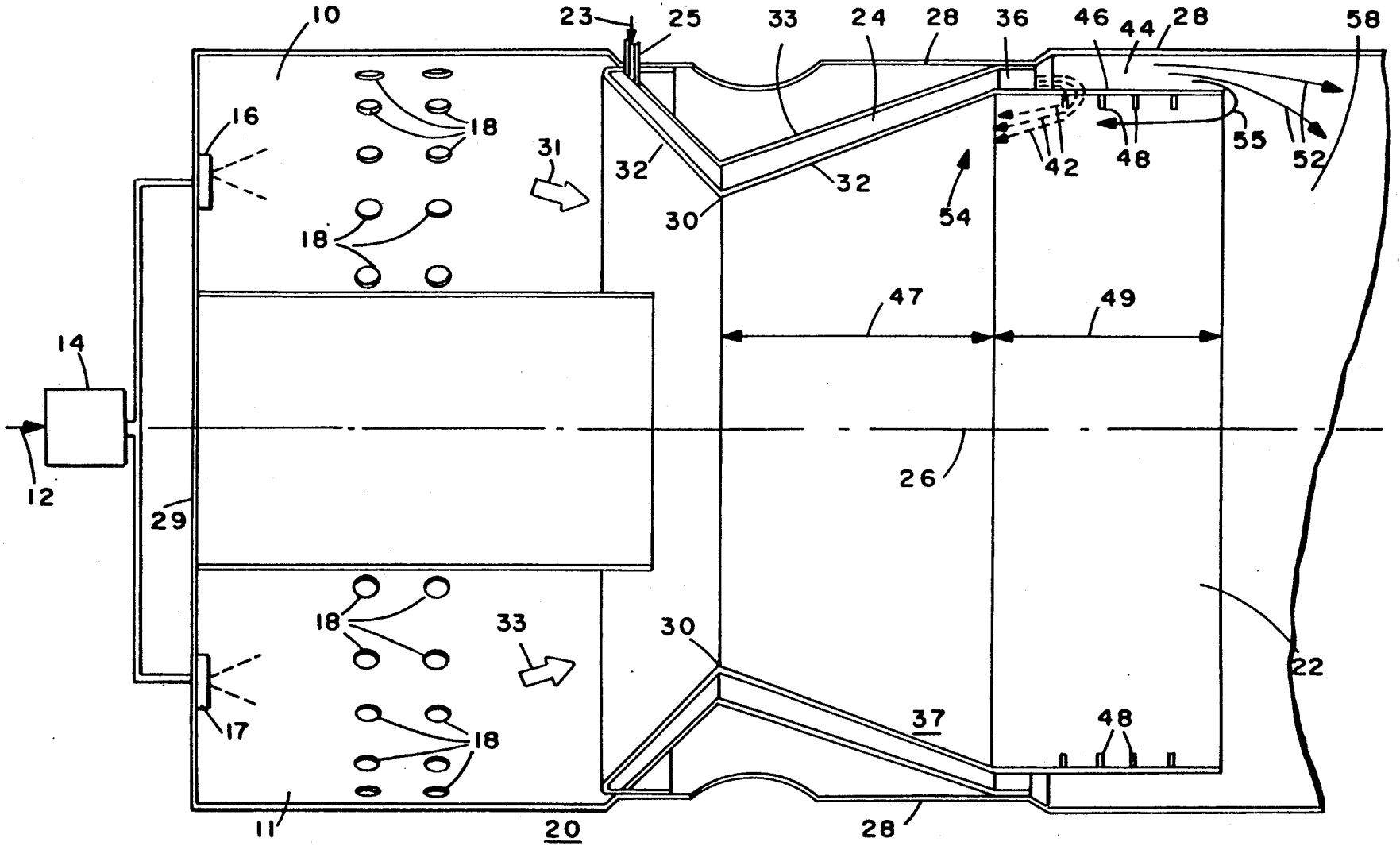
FIG. 1 is a simplified representation of a cross section of a gas turbine combustion system incorporating the present invention.

Referring first to FIG. 1, 10 and 11 are sections of an annular premixing chamber or individual chambers in which fuel gas and air are premixed. The fuel gas 12, which may, for example, be natural gas or other hydrocarbon vapor, is provided through fuel flow controller 14 to one or more fuel nozzles such as 16 and 17 in premixing chambers 10 and 11, respectively. In accordance with the referenced United States Patents and patent applications, there may be a plurality of premixing chambers arranged circumferentially around the upstream end of combustor. While 2 combustion chambers 10 and 11 are shown in FIG. 1, there can be any suitable number of combustion chambers. A single axisymmetric fuel nozzle such as 16 and 17 may be used for each premix chamber. Air is introduced through one or more entry ports such as 18. The air is provided to ports 18 from the gas turbine compressor (not shown) under an elevated pressure of five to fifteen atmospheres.

The premixed fuel and air is provided to the interior of the combustion chamber 22 through venturi 24 formed by angular walls 32 meeting at the constriction or constricted throat 30. The combustion chamber 22 is generally cylindrical in shape about combustor centerline 26 and enclosed by outer walls 28 and 29.

The venturi 24 causes the fuel-air mixture moving downstream in the direction of arrows 31 and 33 to accelerate as it flows through the constricted throat 30 to the combustion chamber 22.

Because the venturi wall, 32 is adjacent the combustion chamber 22, it is necessary to cool the wall with back side impingement air flowing along and through passageway or channel 36 bounded by the venturi walls 32 and generally parallel walls 33. The cooling air 23 may be provided from the turbine compressor (not shown) through the wall 33, at inlet 25, or alternatively through louvers in the wall as described in the aforesaid U.S. Pat. No. 4,292,801. The cooling medium may also be, or include, steam or water mixed with the air.

Arrangements which have dumped the cooling air from the passageway 36 of the venturi 24 have not proven to be as stable in operation over a wide a temperature range as desired, and/or have not provided the optimum low $NO_x$ emissions desired. In studying this during the development of an improved low $NO_x$ combustor 20, we have observed with flow visualization techniques on a full scale plexiglass model of the combustor, that the venturi cooling air dumping into the combustion zone 22, proceeds to "reverse" flow into the separated region or zone adjacent the venturi wall in the downstream area 37. The separated zone is characterized by a detachment of the bulk flow from walls 32 with a small amount of air, and burned and unburned fuel recirculating in the area bounded by the bulk flow and walls 32. The bulk flow detachment is caused by the rapid increase in geometric area downstream of the venturi throat 30. The path of the venturi cooling dump flow in a combustor in which the downstream exit 36 is directly connected to the interior of the combustion chamber 22 was found to be the reverse flow shown by dotted flow lines and arrows 42. Subsequent actual "fired" testing of that dry low $NO_x$ system has shown that reducing the amount of venturi cooling air entering the separated zone improved the stability of the premixed fuel burning operation.

Thus, we have proven that the reverse flow cooling air adversely affects the stability of such venturi combustion systems.

Through further experimentation it was determined that the performance of the combustor could be improved greatly and unexpectedly by providing a controlled cooling air flow dump downstream from the venturi wall 32 toward the combustion zone in the interior of the combustor, and furthermore that this could be accomplished with relatively simple hardware.

Referring again to FIG. 1, the exit channel 36 is connected through the passageway 44 extending downstream from the exit channel and formed by a cylindrical wall 46 which is concentric with and within combustor wall 28 to form the passageway therebetween. The wall 46, since it is also adjacent to the combustion chamber 22, is provided with some cooling such as back side impingement air, film air, or fins such as 48, to transfer heat away from the wall. The wall 46 may be the combustor shroud wall which is adjacent to the combustion process. The length 49 of the passageway 44 is optimized for each combustor design although it is in general some 8 to 10 times the radial width of the venturi exit channel 36. One embodiment of the invention was on a combustor 20 having an internal diameter of 10 inches, a distance 47 of 3 inches axially from the constricted throat 30 of venturi 24 to the downstream exit 49 of the exit channel 36 of the venturi, a throat diameter 30 of 7 inches, and a 2 inch axial length 49 of the passageway 44 formed by cylindrical wall 46 and wall 28. On other embodiments, the internal diameter of the combustor 20 was varied from 10–14 inches, the distance 47 was varied from 3–5 inches, the diameter of the throat 30 was varied from 7–9 inches, and the length of the passageway 44 was varied from 2–7 inches. With this arrangement, the dump cooling air 52 from the venturi 24 was found to be mostly in the downstream flow in the combustion chamber as shown by the arrows 52 with only a small reverse flow 55. We have found that this provides significant benefits as described in more detail below.

However, prior to the actual combustor testing and flow visualization testing on a full scale plexiglass model, it was thought that the venturi cooling air flow through passageway 44 exited to the combustion zone 58 along the wall 28 and did not in its entirety, or substantial entirety, flow upstream against the flow of fuel gas and air into the separated zone 54 as shown by the arrows 42. Contrary to that existing belief, we now believe that the low pressure zone in the separated region or separated zone 54 adjacent to the venturi downstream wall 32 (due to high velocity combustion gases created by the vena contracta of the venturi throat 30) induces the venturi cooling air, which was dumped at the downstream edge of the passageway 36, to flow backwards upstream into the separated zone 54.

The present invention provides a passageway of significant and sufficient length to carry the venturi cooling gas flow further downstream. It is believed that the cooling gas dump should be at least beyond the mid region of the separated zone 54.

Subsequent testing on full pressure, fired combustion equipment with varying length passageways led to the discovery that controlling the amount of cooling fluid entering the separated zone 54 significantly improved the stability of a premixed fuel-air combustor. The improved results included a significant increase in the temperature range over which premixed operation is possible, and, in addition, the ability to operate the combustor 20 with lower combustion system dynamic pressures. It is inferred from temperature measurements of a full pressure, fired combustion system without the passageway 44 that the venturi cooling air significantly cools and dilutes the combustion gases recirculating in the separated zone 54 resulting in reducing the flame holding stability of this region.

Figure 2:
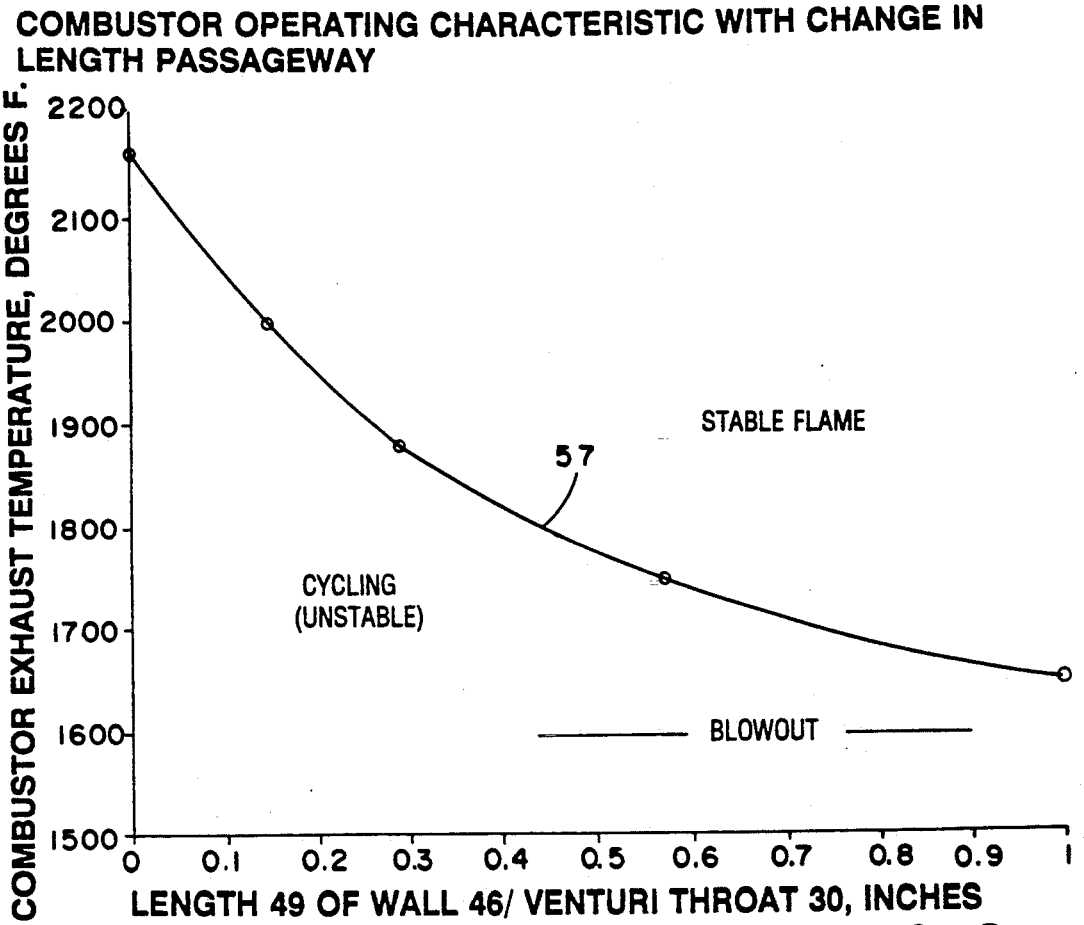
FIG. 2 is a plot of the improved operating characteristics realized through use of the present invention.

FIG. 2 shows the effects of varying the length 49 of the passageway 44. Referring to FIG. 2, the combustor exhaust temperatures in ° F. are plotted on the Y axis and the ratio of the passageway 44 length/width are plotted on the X axis. The stable flame region is above the resultant plot or curve 57 while the cycling or unstable flame region is below the plot. It is to be noted that increasing the length/width ratio lowers the range of temperatures at which the combustor 20 provides a stable flame. FIG. 2 shows how the combustor exhaust temperature varies with changing the length of the venturi air dump 46, made dimensionless using the venturi diameter 30. Below the curve, the combustor begins to operate in a cyclic mode where the premixed combustion is unstable. Below 1600 degrees the premixed fuel gas and air blows out. As an example, if the dimensionless venturi air dump length is 0.25, the dry low $NO_x$ combustor 20 can be operated stably at an exhaust temperature above 1900 degrees. Further, if the full load operating temperature is 2100 degrees, then the combustor can be operated in the premixed firing mode at partial load conditions corresponding to the range in exhaust temperature from 1900 to 2100 degrees. It is to be noted that the stable flame temperature may be lowered from in excess of 2100° F. to less than 1700° F. This ability to maintain stable combustion over a wide range, including lower temperatures, has achieved a desired reduction in the $NO_x$ and carbon monoxide (CO) emissions.

The benefits of the present invention due to the improvement in the premixed operating mode of the dry low $NO_x$ combustor 20 are: (1) greater flexibility in operating the gas turbine because of a larger temperature range, including lower temperatures, over which the combustor is stable and can be fired in the premixed mode, (2) lowered resultant $NO_x$ emissions, (3) lowered CO emissions, (4) increased combustor lifetime and time between inspections due to lower system dynamic pressures, and (5) provision of a means of adjusting the combustor operation such that the emissions can be optimized for a given combustor nominal operating temperature.

Figure 3:
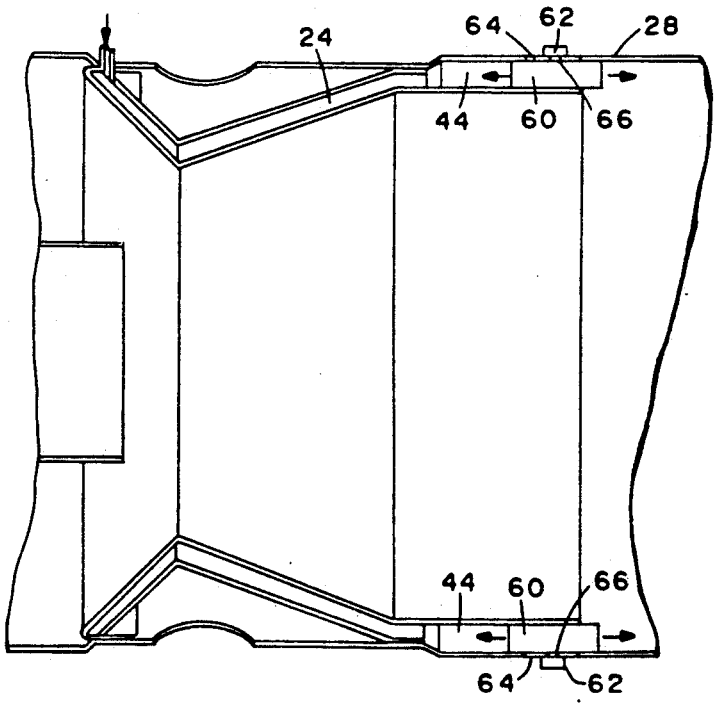
FIG. 3 is a partial cross section, shown in reduced size, of a portion of FIG. 1 incorporating an alternate embodiment of the present invention.

FIG. 3 shows an alternate embodiment of the present invention. Referring to FIG. 3, the length of the passageway 44 is made adjustable to enable adjustable optimization of the present invention under variable operating conditions. A cylindrical sleeve 60 is slidably mounted closely within the passage to enable adjustment of the effective length of passageway 44. Because of the high temperatures and harsh environment of the interior of combustor 20 most installations may include a non-adjustable wall 46 which is designed for optimum operating characteristics. The adjustment mechanism shown schematically as controls 62 may be of any suitable type for the combustor 20 environment such as a rack and pinion mechanism or simply movement of the sleeve 60 by the control 62 moving within an axial slot 64 in wall 28, with control 62 being threaded fasteners to secure the sleeve in the desired location by screwing the fasteners tightly into the threaded bores 66 in the sleeve.

While the present invention has been described with respect to certain preferred embodiments thereof, it is to be understood that numerous variations in the details of construction, the arrangement and combination of parts, and the type of materials used may be made without departing from the spirit and scope of the invention.

What we claim is:

1. A dry low nitric oxides ($NO_x$) emission combustor comprising:

a premixing chamber for mixing fuel gas and air;

a combustion chamber positioned downstream of said premixing chamber for the combustion of the premixed fuel gas and air and including a separated zone and a combustion zone downstream from said separated zone;

a venturi having a generally annular wall including diverging wall portions and positioned between said premixing chamber and said combustion chamber through which said premixed fuel gas and air pass to said combustion chamber, said separated zone being disposed between the walls of said venturi including said diverging wall portions and bulk flow detached from the walls of said venturi;

a passageway for cooling gas flow extending axially along and adjacent a portion of the downstream surface of said venturi in the region of said combustion chamber and having an exit for flowing cooling gas to the combustion zone;

said passageway positioned on the side of said venturi opposite that which said premixed fuel gas and air passes to said combustion chamber; and said passageway extending sufficiently downstream in said combustion chamber to substantially minimize backflow of said cooling gas into said separated zone after exiting said passageway to enhance flame stability in said combustion zone;

whereby said combustor may be effectively fired over a substantial temperature range to reduce the $NO_x$ emissions of said combustor.

2. The combustor of claim 1 wherein said venturi includes a constriction to the flow of said fuel gas and air, and said passageway includes an exit downstream from said constriction adjacent the periphery of said combustion chamber.

3. The combustor of claim 2 wherein said passageway is formed inside a first wall of said combustor by a second wall substantially parallel to said wall of said combustor forming said passageway therebetween.

4. The combustor of claim 3 wherein said passageway is formed within the shroud of said combustor.

5. The combustor of claim 4 wherein said first wall of said combustor is substantially cylindrical and is disposed about an axis and said second wall is within, and concentric with, said first wall of said combustor.

6. The combustor of claim 5 wherein the axial length of said passageway is greater than the radial distance between said wall of said combustor and said second wall.

7. The combustor of claim 6 wherein the length of said passageway is in the order of 8 to 10 times the distance between the walls of said passageway.

8. The combustor of claim 7 wherein said cooling gas includes air.

9. The combustor of claim 2 wherein the length of said passageway is in the range of 2 to 7 inches.

10. The combustor of claim 9 wherein the length of said passageway is at least about 2 inches.

11. The combustor of claim 10 wherein the diameter of said combustor is in the order of 10 to 14 inches and the throat constriction of said venturi is in the order of 7 to 9 inches.

12. The combustor of claim 11 wherein the length of said passageway is adjustable.

13. The combustor of claim 2 wherein said exit is located such that the ratio of the length of said passageway to the width of said passageway over the range of 0 to 1 provides a stable flame temperature over a range which is inversely related to said ratio.

14. The combustor of claim 13 wherein said temperature range is in the order of in excess of 2100° F. to less than 1700° F.

15. A combustor of claim 1 wherein said exit is located downstream of and beyond a mid-region of said separated zone.

* * * * *